US005850813A

United States Patent [19]

Cooney et al.

[11] Patent Number: 5,850,813

[45] Date of Patent: Dec. 22, 1998

[54] SPLIT INTAKE MANIFOLD, STRUCTURE, INSTALLATION AND METHOD

[75] Inventors: Rick Cooney, Las Vegas, Nev.; Dennis A. Sheehan, 10952 Longford St., Lake View Terrace, Calif. 91342

[73] Assignee: Dennis A. Sheehan, Sun Valley, Calif.

[21] Appl. No.: 871,871

[22] Filed: Jun. 9, 1997

[51] Int. Cl.[6] ..... F02M 35/10

[52] U.S. Cl. ..... 123/184.46; 123/184.32

[58] Field of Search ..... 123/184.32, 184.39, 123/184.46

[56] References Cited

U.S. PATENT DOCUMENTS

| | | | |
|---|---|---|---|
| 1,011,694 | 12/1911 | Winton | 123/184.39 |
| 1,399,065 | 12/1921 | Loomis | 123/184.32 |
| 4,153,015 | 5/1979 | Hampton | 123/184.46 |
| 4,862,839 | 9/1989 | Bridges . | |
| 5,042,435 | 8/1991 | Feuling | 123/579 |
| 5,076,218 | 12/1991 | Graziadei | 123/590 |
| 5,275,420 | 1/1994 | Rodenkirch | 277/1 |
| 5,310,588 | 5/1994 | Carlson et al. . | |

*Primary Examiner*—Noah P. Kamen
*Attorney, Agent, or Firm*—Harry M. Weiss; Jeffrey D. Moy; Harry M. Weiss & Associates, P.C.

[57] ABSTRACT

A substantially Y shaped split intake manifold is disclosed and also a method of connecting this manifold having fuel-air outlet conduits to a plurality of internal combustion engine cylinder inlet ports. The method comprises the steps of applying a layer of high temperature resistant rubber sealant that remains flexible upon curing to the two outlet passages or conduits of the split intake manifold for forming gas-tight seals between the two outlet passages of the manifold and the associated two inlet ports of the two cylinders of the internal combustion engine and allowing the sealant to cure in situ to adhesively bond to the two outlet passages of the manifold.

8 Claims, 1 Drawing Sheet

SPLIT INTAKE MANIFOLD, STRUCTURE, INSTALLATION AND METHOD

FIELD OF THE INVENTION

This invention generally relates to internal combustion engines and methods and, in particular, to manifolds for motorcycle engines and methods therefor.

BACKGROUND OF THE INVENTION

Intake manifolds for connecting one or more carburetors to a plurality of cylinders of a multi-cylinder internal combustion engine are well-known. Generally, it is highly desirable to provide the equivalent amount of the same air-fuel mixture to each of the cylinders to assure smooth, uniform power development in each of the cylinders. This arrangement is very commonly, almost universally, used in automobile engines and is also widely used in motorcycle engines. U.S. Pat. No. 4,862,839, Sep. 5, 1989, describes one exemplary manifold.

Most manifolds of this type comprise a single cast metal body which is configured and constructed to define passages from the carburetor to the respective cylinders, mounting flanges, etc. While this arrangement is, in general, economical and entirely satisfactory in automobiles, it is not always so in motorcycle engines It is often very difficult to provide the equivalent amount of the same air-fuel mixture to, for example, two separate cylinders of a motorcycle engine. Also, some types of motorcycle engines have a very pronounced tendency to develop leaks in the intake manifold connections. These connections generally rely on various gaskets or "O" rings to make an air tight seal, and these seals tend to fail as the engine heats and cools and vibrates during its use cycles.

Single body manifolds of the type described above are so configured as to severely restrict the kinds of seals that can be used and render it nearly impossible to make an enduring gas tight seal.

The problems resulting from this propensity to leak are most severe. At best, the internal combustion engine runs roughly and inefficiently because the required optimum air-fuel mixture is changed or modified by the leak, which may also vary with temperature change and vibration. Even worse, if the fuel-air ratio becomes too lean, the mixture will explode, rather than burn as it should. These explosions or back firings cause at least minor damage to all of the moving combustion components, i.e., the cylinders, bearings, valves, etc., and, if permitted to continue, will destroy some of these structures.

SUMMARY OF THE INVENTION

It is an object of this invention to provide an improved manifold and method therefor that will result in reliably providing optimum air-fuel mixture amounts to each cylinder and also provide a permanent, air tight connection to the cylinder inlet.

It is a further object of this invention to provide a split-intake manifold and method for a motorcycle internal combustion engine that will reliably provide from the carburetor the optimum air-fuel mixture to each of the two cylinders of the motorcycle's internal combustion engine.

It is a still further object of this invention to provide a split-intake manifold and method for a motorcycle internal combustion engine that will have reliable, leak-free sealants between the split-intake manifold and the two cylinders of the internal combustion engine coupled thereto to insure that each of the two cylinders will receive the equivalent correct optimum air-fuel mixture.

BRIEF DESCRIPTION OF THE PREFERRED EMBODIMENTS

A multi-cylinder engine and a manifold for use therein and a method of securing the manifold in gas tight relation to the input ports of the two cylinders of a motorcycle internal combustion engine is disclosed. The manifold is a split intake manifold and comprises an upper member and a lower member. The members are configured and constructed to fit together in a gas tight relationship. When so fitted together the members define an inlet air-fuel mixture conduit or input conduit means constructed and configured for receiving the output air-fuel mixture from a carburetor and two outlet or output air-fuel mixture conduits or plural output conduit means. The single inlet conduit of the split intake manifold is in fluid communication with the two outlet conduits of the split intake manifold (one for each of the two cylinders). The two outlet conduits are disposed with respect to the single inlet conduit and to each other to permit the two outlet conduits to be respectively connected to two separate internal combustion engine cylinder input ports for passing the air-fuel mixture from the carburetor to the two respective cylinders. The two outlet or output connections to the two cylinders preferably each have a flexible high temperature resistant rubber seal means adhesively bonded internally to the two outlet conduits of the split intake manifold for forming a gas-tight seal between the two outlet conduits of the split intake manifold and the associated and coupled two inlet ports of the two cylinders of the motorcycle's internal combustion engine. In the most preferred embodiment, the seals between the two outlet conduits of the split intake manifold and the associated and coupled two inlet ports of the two cylinders of the motorcycle's internal combustion engine comprise a high temperature resistant silicone rubber sealant vulcanized in situ in the two outlet conduits of the split intake manifold.

A method of connecting a split intake manifold having two fuel-air outlet ports to a plurality (i.e. two) of internal combustion engine cylinder inlet ports is another embodiment of the invention. The method comprises the steps of applying a layer of high temperature resistant rubber sealant that remains flexible upon curing to the two outlet conduits of the split intake manifold for forming a gas-tight seal between the two outlet conduits of the split intake manifold and the two inlet ports of the two cylinders and allowing the sealant to cure in situ to adhesively internally bond to the two outlet conduits of the split intake manifold. The seals each preferably comprise a high temperature resistant, silicone rubber sealant. In order to facilitate the method and, in some internal combustion engines, to make it possible to carry out the method, the split intake manifold comprises an upper member and a lower member. Each of these members are configured and constructed as to fit together in a gas tight relationship and when so fitted together they both define a single inlet air-fuel mixture conduit constructed and configured for receiving the air-fuel mixture from a carburetor and two outlet air-fuel mixture conduits. The single inlet conduit being in fluid communication with the two outlet conduits, with the two outlet conduits being so disposed with respect to the single inlet conduit and to each other as to permit the two outlet conduits to be respectively connected to two separate internal combustion engine cylinder input ports of a motorcycle internal combustion engine for reliably and completely passing the air-fuel mixture from the carburetor to the respective two cylinders.

The foregoing and other objects, features and advantages of this invention will be apparent from the following more particular description of the preferred embodiments of the invention as illustrated in the accompanying drawings.

DESCRIPTION OF THE PREFERRED EMBODIMENTS

Figure 1:
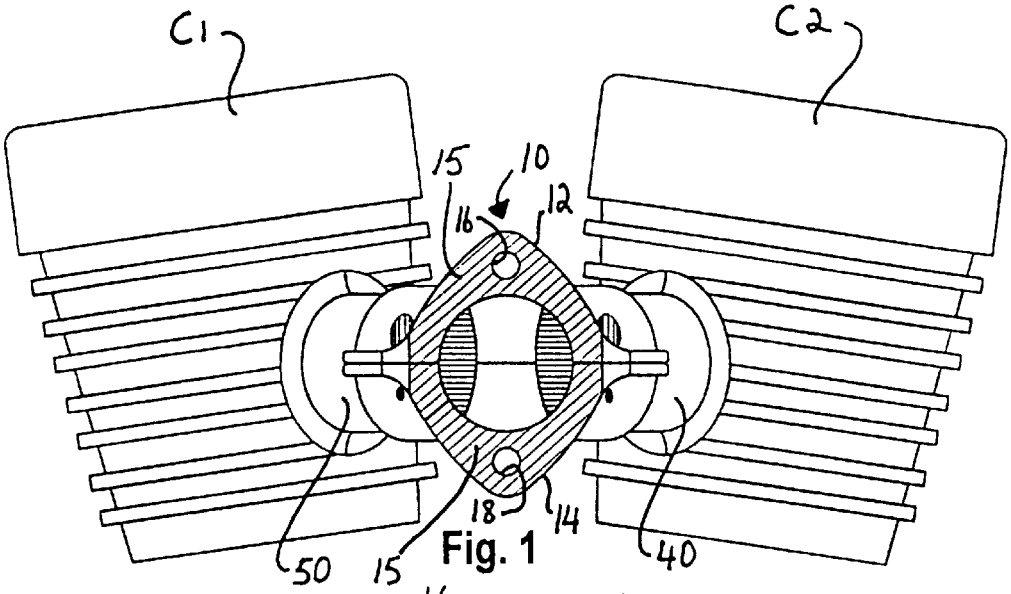
FIG. 1 depicts the substantially split Y shaped manifold of this invention connected to the inlet ports of a pair of cylinders of a motorcycle engine viewed from the carburetor connection side, referred to hereinafter as the "front" or "inlet" side of the manifold.
Figure 2:
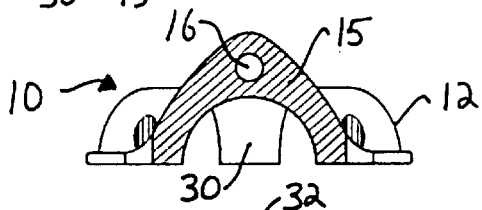
FIG. 2 depicts the split Y manifold of FIG. 1 of this invention removed and shown exploded vertically to show how the two split halves of the manifold fit together.
Figure 2:
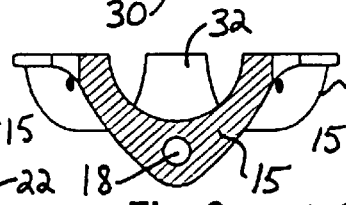

With reference to FIGS. 1 and 2, the substantially Y shaped split intake manifold 10 of this invention comprises an upper half 12 and a lower half 14, each configured and constructed to mate together generally along a center line to form, when so mated, a split intake manifold that defines an inlet port that is coupled to the carburetor (not shown) of an internal combustion engine (not shown) and two outlet ports for respective connection to the two inlet ports of cylinders of the internal combustion engine. A centrally disposed split flange 15 is provided with a pair of bolt passages 16 and 18 and is defined by the two halves thereof for permitting attachment to a carburetor (not shown).

Figure 3:
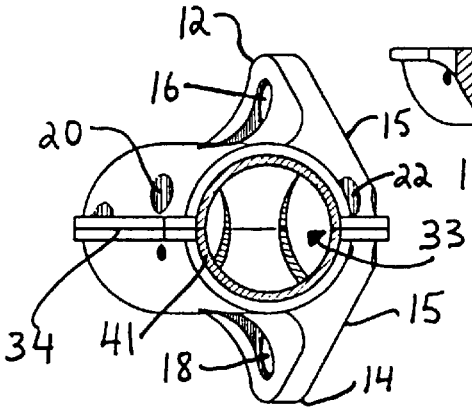
FIG. 3 is a view of the left outlet end of the split intake manifold of FIG. 1, with the two split halves fitted together.
Figure 4:
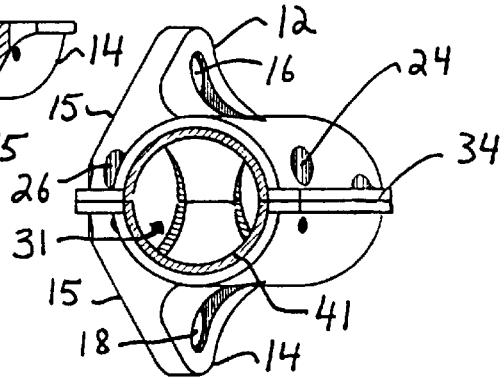
FIG. 4 is a view of the right outlet end of the split intake manifold of FIG. 1, with the two halves fitted together.

With reference to FIG. 3, a pair of bolt or screw passages, one or both of which may be threaded, identified at 20 and 22 in the left side and at 24 and 26 in the right side (see FIG. 4) are provided for clamping the two halves 15 of the substantially Y shaped split intake manifold 10 together. Internal back integral structures 30 and 32 mate at the rear internal portion of the substantially Y shaped split intake manifold 10 to define two outlet passages 31 and 33 (see FIG. 5) when the two split halves 15 are joined along the generally central joining face 34 (see FIGS. 3 and 4).

The substantially Y shaped split intake manifold 10 is configured and constructed to be used with a pair of cylinder intake conduits 40 and 50, shown in FIG. 1.

Figure 5:
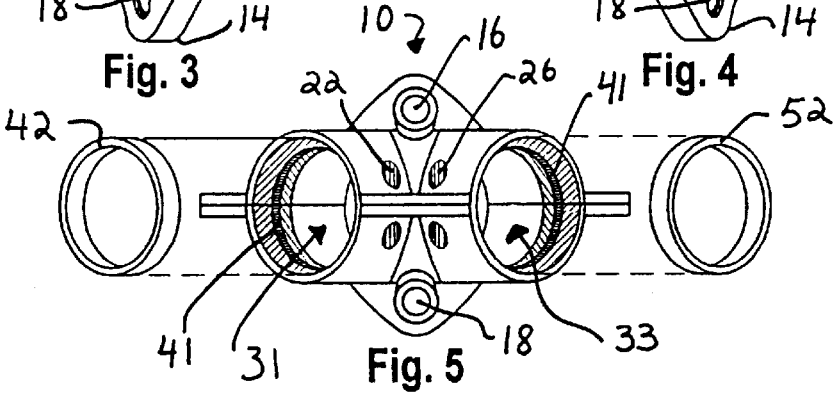
FIG. 5 depicts the split Y shaped manifold of FIG. 1 of this invention, and the connecting pair of outlet conduits or tubes for connection to the respective two inlet ports of a pair of cylinders (as shown in FIG. 1) of the motorcycle internal combustion engine, viewed from the two cylinder inlet connection sides, referred to hereinafter as the "back" or "outlet" side of the split intake manifold.

The method of installation of the substantially Y shaped split intake manifold 10 is very much simpler than the method required by prior art manifolds. The first step, and a most important step, in the installation is to apply a thin, uniform amount of heat resistant RTV silicone adhesive as described below. RTV silicone adhesive cures irreversibly at room temperature, hence the denomination as RTV (Room Temperature Vulcanizing) adhesive, to form a strong, flexible, heat proof, heat resistant seal. The RTV silicone adhesive is applied uniformly in a thin layer to a cylindrical flange or rim portion 41 (see FIG. 5) inside of the two outlet passages 31 and 33 that are respectively coupled to the two inlet ports going into the cylinders. Intake conduits 40 and 50 are respectively coupled to cylinders C2 and C1 (see FIG. 1). The two RTV silicone adhesive seals which are depicted by reference numbers 42 and 52 in FIG. 5 are preferably applied (from a spout of a tube containing the RTV silicone adhesive) uniformly in a thin layer to the two inside rim portions that define the two outlet passages 31 and 33 of the substantially Y shaped split intake manifold 10. All excess adhesive, inside and outside is carefully removed before the split halt pieces respectively are fitted into position. The use of the split manifold 10 of this invention with its internal pair of rim portions 41 makes it both possible and simple to provide a thin uniform RTV silicone rubber adhesive layer to join the manifold 10 to the cylinder inlet conduits 50 and 40. The two halves of the manifold 10 and a properly formed RTV silicone rubber adhesive such as seals 42 and 52 permits the split manifold 10 to be joined together in a leak proof manner and the two halves of the manifold 10 are secured by bolts or screws. It is convenient to thread the lower part of the passages 20, 22, 24 and 26 and to join the two halves from the top using either bolts or, if desired, screws. Preferably the two halves of the manifold 10 are first joined loosely and then tightened together uniformly by snugging the screws, then drawing the manifold 10 together in a gas tight joint by evenly tightening the screws in sequence to a uniform torque. After tightening, any excess sealant, inside and outside, is again carefully removed.

It should be noted that the method of installation as described above is carried out, if at all, with great difficulty using prior art manifolds. The use of the split manifold 10 as described herein makes it possible and much easier and more efficient to carry out the installation method in a leak proof manner.

High temperature resistant sealants that are viscous fluids or gels that have little tendency to run and which cure at room temperature or at a temperature no higher than the ambient operating temperature of the manifold 10 and which remain flexible after curing are suitable for use in this invention. The most satisfactory sealants presently known are high temperature resistant silicone rubbers that are self-curing, i.e., vulcanize in situ from a fluid to a solid resilient rubbery state upon exposure to air. Such sealants are commercially available in automobile parts stores and hardware stores or from suppliers such as General Electric Company. U.S. Pat. Nos. 4,092,192, May 30, 1978, and 5,310,588, May 10, 1994, describe materials of this type. The sealant described in the latter U.S. Pat. No. 5,310,588, is stable at working temperatures up to 700° F. The precise chemical structure or formula for the sealant is not critical, however, as many such products are available for use by those skilled in the art.

Many variations as to size and shape may be made within the scope of the invention to accommodate to the configuration of multi-cylinder engines (and, if desired, more than two cylinder internal combustion engines), and several kinds of materials, e.g., cast iron or steel, stainless steel, aluminum, etc., and various adhesive sealants may be used without departing from the invention. The Term cylinder intake conduits or inlet ports for the cylinder is equivalent to the term that is used in the art known as cylinder heads. Thus, these terms are all included in the coverage of the following patent claims by the use of the term input ports.

INDUSTRIAL APPLICATION

This invention is useful in the manufacture, modification and repair of internal combustion engines generally and motorcycle engines in particular. The invention is especially useful for the Harley Davidson Twin Motorcycle Engine.

What is claimed is:

1. A manifold for a multi-cylinder internal combustion engine comprising a separate upper member and a separate lower member, each said member being so configured and constructed as to fit together in gas tight relationship and when so fitted together to define an inlet air-fuel mixture conduit constructed and configured for receiving a carburetor and two outlet air-fuel mixture conduits, said inlet conduit being in fluid communication with said outlet conduits, said outlet conduits being so disposed with respect to the inlet conduit and to each other as to permit said outlet conduits to be connected to separate internal combustion engine cylinder input ports for passing an air-fuel mixture from the carburetor to the separate internal combustion engine cylinder input ports of respective cylinders.

2. In a multi-cylinder internal combustion motorcycle engine having a manifold for passing an air-fuel mixture to cylinders of said engine, the improvement wherein the manifold comprises a separate upper member and a separate lower member, said members being so configured and constructed as to fit together in gas tight relationship and when so fitted together to define an inlet air-fuel mixture conduit constructed and configured for receiving a carburetor and outlet air-fuel mixture conduits, said inlet conduit being in fluid communication with said outlet conduits, said outlet conduits being so disposed with respect to the inlet conduit and to each other as to permit said outlet conduits to be connected to separate internal combustion engine cylinder input ports for passing an air-fuel mixture from the carburetor to the separate internal combustion engine cylinder input ports of respective cylinders.

3. The manifold of claim 2 further comprising flexible high temperature resistant rubber seals adhesively bonded to the manifold within said outlet conduits for forming a gas-tight seal between said manifold and said input ports.

4. The manifold of claim 3 wherein the seals comprise high temperature resistant silicone rubber sealant vulcanized in situ within said manifold.

5. The method of claim 4 wherein the manifold comprises a separate upper member and a separate lower member, each said member being so configured and constructed as to fit together in gas tight relationship and when so fitted together to define an inlet air-fuel mixture conduit constructed and configured for receiving a carburetor and said plural air-fuel outlet conduits, said inlet conduit being in fluid communication with said two outlet conduits, said two outlet conduits being so disposed with respect to the inlet conduit and to each other as to permit each of said two outlet conduits to be respectively connected to a separate internal combustion engine cylinder input port for passing an air-fuel mixture from the carburetor to each separate internal combustion engine cylinder input port of each respective cylinder.

6. The method of claim 5 wherein the manifold comprises a separate upper member and a separate lower member, each said member being so configured and constructed as to fit together in gas tight relationship and when so fitted together to define an inlet air-fuel mixture conduit constructed and configured for receiving a carburetor and said plural air-fuel outlet conduits, said inlet conduit being in fluid communication with said two outlet conduits, said two outlet conduits being so disposed with respect to the inlet conduit and to each other as to permit each of said two outlet conduits to be respectively connected to a separate internal combustion engine cylinder input port for passing an air-fuel mixture from the carburetor to each separate internal combustion engine cylinder input port of each respective cylinder.

7. A substantially Y shaped split intake manifold for an internal combustion engine comprising, in combination:

a separate upper member and a separate lower member;

input conduit means coupled to said upper member and said lower member for accepting an air-fuel mixture from a carburetor;

plural output conduit means each coupled to said upper member and said lower member for receiving said air-fuel mixture from said input conduit means and for providing an equal amount of said air-fuel mixture to respective plural cylinders of said internal combustion engine.

8. The manifold of claim 5 wherein flexible high temperature resistant rubber seals means are adhesively bonded within each one of said plural output conduit means for providing a leak proof seal between said manifold and the respective plural cylinders.

* * * * *